US009044940B2

(12) United States Patent
Naoe et al.

(10) Patent No.: US 9,044,940 B2
(45) Date of Patent: Jun. 2, 2015

(54) INKJET PRINTING APPARATUS

(71) Applicant: DAINIPPON SCREEN MFG. CO., LTD., Kyoto-shi, Kyoto (JP)

(72) Inventors: Ryouichi Naoe, Kyoto (JP); Mitsuru Tanemoto, Kyoto (JP); Katsuaki Takeuchi, Kyoto (JP)

(73) Assignees: SCREEN HOLDINGS CO., LTD., Kyoto (JP); RICOH COMPANY, LTD., Tokyo (JP)

( * ) Notice: Subject to any disclaimer, the term of this patent is extended or adjusted under 35 U.S.C. 154(b) by 93 days.

(21) Appl. No.: 13/629,259

(22) Filed: Sep. 27, 2012

(65) Prior Publication Data

US 2013/0088540 A1 Apr. 11, 2013

(30) Foreign Application Priority Data

Sep. 29, 2011 (JP) ..... 2011-214336

(51) Int. Cl.

| | |
|---|---|
| ***B41J 29/38*** | (2006.01) |
| ***B41J 2/115*** | (2006.01) |
| ***B41J 2/165*** | (2006.01) |
| ***B41J 23/02*** | (2006.01) |

(52) U.S. Cl.

CPC ..... *B41J 2/115* (2013.01); *B41J 2/16585* (2013.01); *B41J 23/02* (2013.01)

(58) Field of Classification Search

CPC ..... B41J 29/38; B41J 19/202; B41J 25/308; B41J 25/001; B41J 25/304; B41J 19/232; B41J 2/115; B41J 2/16585; B41J 23/02

USPC ..... 347/14

See application file for complete search history.

(56) References Cited

U.S. PATENT DOCUMENTS

| | | | | | |
|---|---|---|---|---|---|
| 4,606,254 | A | * | 8/1986 | Schmalz | 83/871 |
| 5,150,030 | A | * | 9/1992 | Ito et al. | 318/811 |
| 5,264,769 | A | * | 11/1993 | Itoh | 318/685 |
| 5,522,799 | A | * | 6/1996 | Furukawa | 604/65 |
| 5,757,397 | A | * | 5/1998 | Hirano et al. | 347/30 |
| 6,182,492 | B1 | * | 2/2001 | Raffin et al. | 72/454 |

FOREIGN PATENT DOCUMENTS

| | | | | |
|---|---|---|---|---|
| FR | WO 9212091 | * | 7/2002 | B66F 11/04 |
| JP | 3320179 B2 | | 9/2002 | |

* cited by examiner

*Primary Examiner* — Alessandro Amari
*Assistant Examiner* — Michael Konczal
(74) *Attorney, Agent, or Firm* — McDermott Will & Emery LLP

(57) ABSTRACT

An inkjet printing apparatus for printing images on printing paper by discharging ink while moving inkjet heads and the printing paper relative to each other. The apparatus includes an inkjet head holder for holding the inkjet heads, a controller for operating a plurality of motors to move the inkjet head holder vertically at least between a printing position and an origin position, and a monitoring unit for monitoring, during a vertical movement caused by the controller, synchronous rotations of the plurality of motors, and corresponding directions of rotation of the plurality of motors.

5 Claims, 8 Drawing Sheets

INKJET PRINTING APPARATUS

BACKGROUND OF THE INVENTION (1) Field of the Invention

This invention relates to an inkjet printing apparatus for printing on printing paper by discharging ink droplets from inkjet heads while moving the inkjet heads and the printing paper relative to each other.

(2) Description of the Related Art

There are inkjet printing apparatus which form images on printing paper while moving the inkjet heads and the printing paper relative to each other. Such inkjet printing apparatus are operable in a multi-pass mode for performing printing while moving the inkjet heads in a width direction of the printing paper, or a one-pass mode for performing printing with the inkjet heads covering the width of the printing paper, and thus without moving the inkjet heads in the width direction of the printing paper.

In the apparatus of the one-pass mode, the inkjet heads covering printing areas of the printing paper are arranged on an inkjet head holder, and the inkjet heads usually are longer than those of the apparatus of the multi-pass mode. Further, an apparatus is known which has a printing position and a cap position located above the printing paper in order to avoid a large occupancy area. The printing position is a position where the printing paper and the inkjet heads are close to each other. The cap position is a position where the printing paper and the inkjet heads are away from each other and the inkjet heads are closed by caps. For this purpose, a construction is needed for raising and lowering the inkjet heads together with the inkjet head holder relative to the printing paper.

A known construction for raising and lowering the inkjet head holder includes, for example, one pulse motor, and a transmission mechanism for transmitting torque to opposite ends of the inkjet head holder.

There is an infusion pump as a known device for performing the above raising and lowering operations using one pulse motor. See Japanese patent No. 3320179 (paragraphs "0077" and "0078", and FIGS. 5-8), for example.

This infusion pump includes a slit disk attached to a shaft of the pulse motor and having slits arranged at unequal intervals in a circle, with mutually different lengths in a direction of rotation, a table storing values of at least either of the lengths in the direction of rotation of the slits and the slit intervals, a photosensor for detecting the slits of the slit disk and outputting detection signals, and a rotational position detecting device for detecting a rotational position of the pulse motor by identifying, based on the detection signals of the photosensor and the table, at least one of a slit in the position of the photosensor and a slit interval. This construction can detect a reversal of the pulse motor.

The conventional example with such a construction has the following drawback.

The inkjet heads for the one-pass mode, in particular, are long in the width direction of the printing paper, and with the construction which transmits the torque of one pulse motor through the transmission mechanism, the transmission mechanism becomes too long sideways, resulting in a notable rotational lag between right and left. Therefore, the conventional apparatus noted above cannot appropriately raise and lower the inkjet head holder holding the inkjet heads.

Then, it is conceivable to provide two pulse motors for the opposite ends in the width direction of the inkjet head holder, respectively, to raise and lower the inkjet head holder while synchronizing the two pulse motors. However, with the plurality of controlled objects, there occurs a problem that it is difficult to perform raising and lowering control of the inkjet head holder appropriately while detecting a reversal and stepout of each pulse motor. Particularly when the opposite ends of the inkjet head holder move to different height positions, the inkjet head holder will be subjected to torsion. When a raising and lowering operation is continued in such state, in the worst case the inkjet head holder can be damaged.

The same problem as above may occur not only with an apparatus for the one-pass mode, but with an apparatus for the multi-pass mode, which may be an inkjet printing apparatus having a mechanism for raising and lowering the inkjet head holder with a plurality of motors.

SUMMARY OF THE INVENTION

This invention has been made having regard to the state of the art noted above, and its object is to provide an inkjet printing apparatus which can raise and lower an inkjet head holder reliably with a plurality of motors, and prevent damage to the inkjet head holder.

The above object is fulfilled, according to this invention, by an inkjet printing apparatus for printing images on printing paper by discharging ink while moving inkjet heads and the printing paper relative to each other, comprising an inkjet head holder for holding the inkjet heads; a control device for operating a plurality of motors to move the inkjet head holder vertically at least between a printing position and an origin position; and a monitoring device for monitoring, during a vertical movement caused by the control device, synchronous rotations of the plurality of motors, and corresponding directions of rotation of the plurality of motors.

According to this invention, when the control device operates the plurality of motors to move the inkjet head holder vertically, the monitoring device monitors synchronous rotations of the plurality of motors and corresponding directions of rotation thereof. An abnormality occurring to these indicates that torsion has occurred to the inkjet head holder. This allows a measure to be taken such as stopping rotation of each motor. As a result, damage to the inkjet head holder can be prevented.

In this invention, the inkjet printing apparatus may comprise a detecting device for detecting synchronism of the rotations of the plurality of motors and the directions of rotation of the plurality of motors, wherein the monitoring device is arranged to monitor the synchronous rotations and the corresponding directions of rotation of the plurality of motors.

The above construction allows the monitoring device to check, by monitoring signals from the detecting device, whether an abnormality has occurred to the synchronous rotations and the directions of rotation of the motors.

In this invention, the detecting device may be arranged to detect slits formed in at least two different sizes in each of slit disks rotatable by the plurality of motors, and output signals concerning the synchronous rotations and directions of rotation of the plurality of motors.

By detecting the slits formed in two different sizes in each slit disk, the synchronous rotations and the directions of rotation of the plurality of motors can be checked relatively easily.

In this invention, the slit disks may be attached to a plurality of ball screws extending in a direction of vertical movement of the inkjet head holder and rotatable by the plurality of motors for vertically moving the inkjet head holder.

Since the slit disks rotate with rotation of the plurality of ball screws, the detecting device detecting the slit disks enables checking of the synchronism and corresponding directions of rotation of the plurality of motors.

In this invention, the monitoring device may be arranged to check synchronism by counting the slits of the slit disks, and check the directions of rotation by monitoring orders in which the slits of the slit disks appear.

Whether the plurality of motors are rotating synchronously or asynchronously can be determined by incrementing the count whenever a slit of each slit disk appears, and comparing the count values. The slits are formed in two different sizes in each slit disk. Therefore, when a change occurs from appearance in the order of large, small, large and small to appearance in the order of small, large and so on, this indicates a reversal of rotation. Directions of rotation can be determined in this way. By making such determination, an abnormality can be found with a relatively simple construction.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

One embodiment of this invention will be described hereinafter with reference to the drawings.

Figure 1:
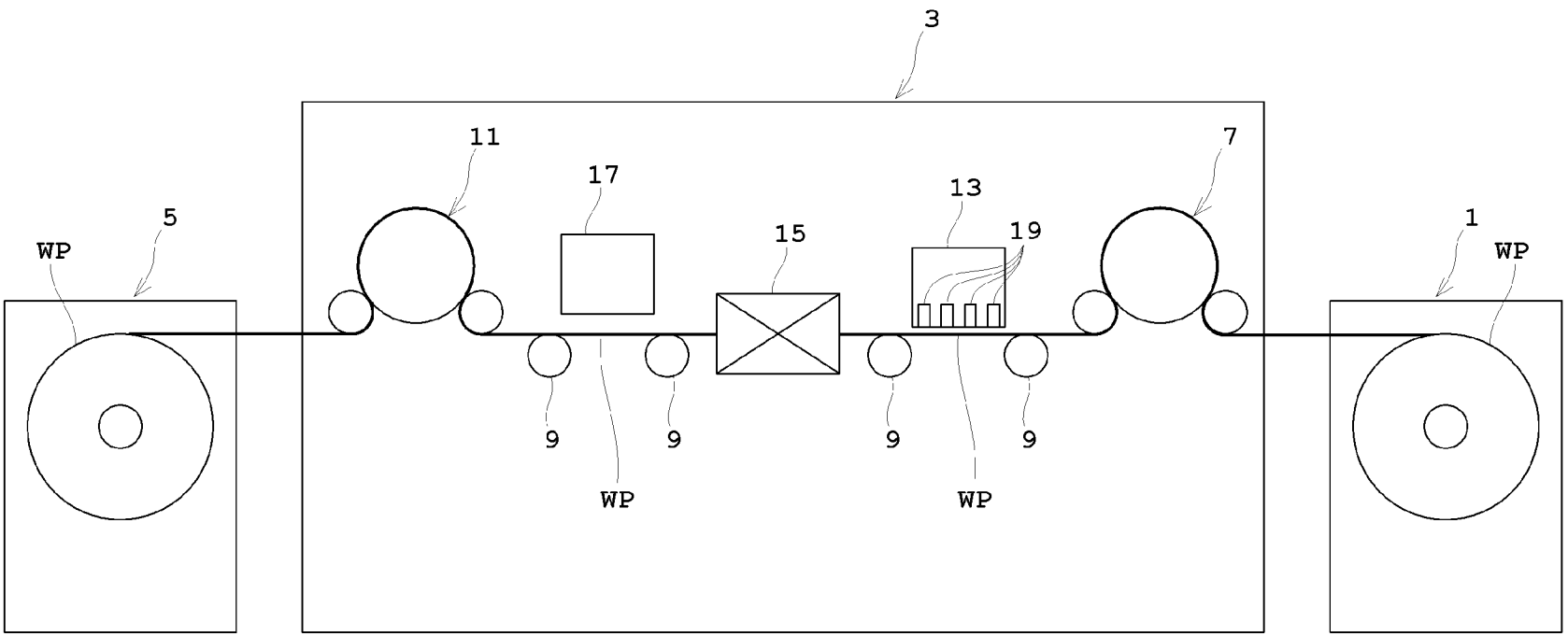
FIG. 1 is a schematic view showing an entire inkjet printing system according to this invention.
Figure 2:
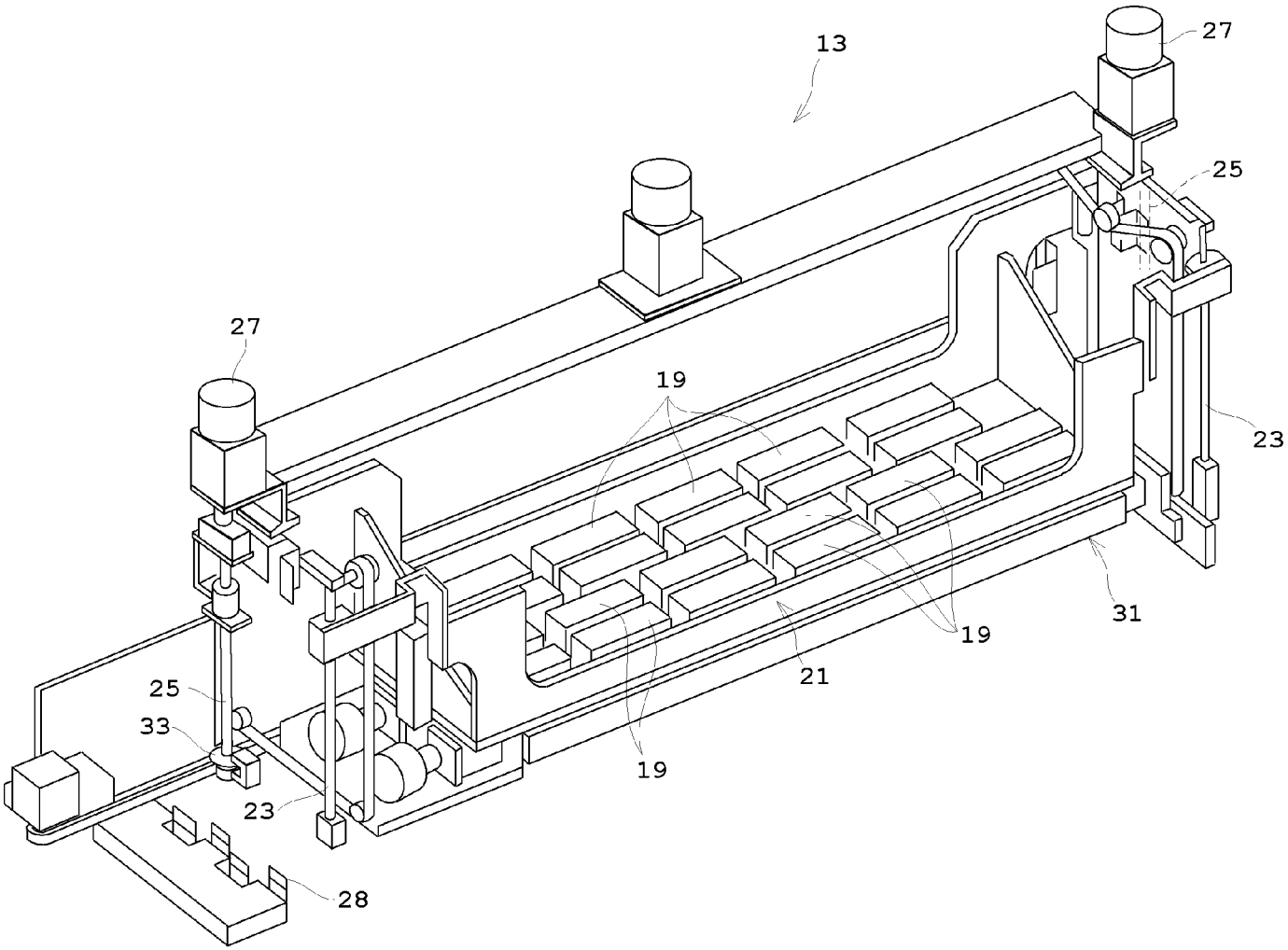
FIG. 2 is a perspective view of a printing unit.
Figure 3:
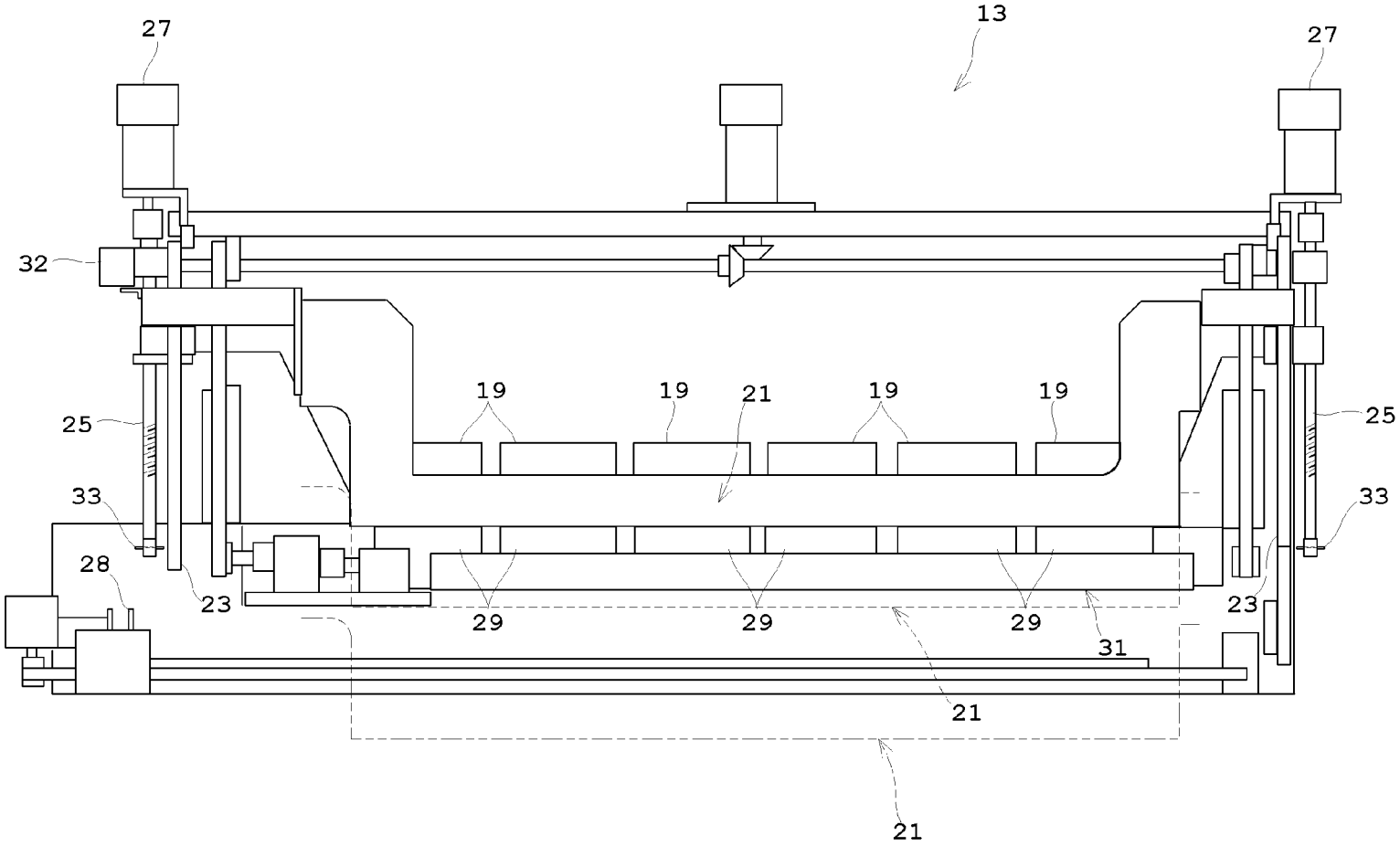
FIG. 3 is a front view of the printing unit.

FIG. 1 is a schematic view showing an entire inkjet printing system according to this invention. FIG. 2 is a perspective view of a printing unit. FIG. 3 is a front view of the printing unit.

The inkjet printing system according to this invention includes a paper feeder 1 for feeding web paper WP stored in a roll form, an inkjet printing apparatus 3 for performing printing on the web paper WP, and a takeup roller 5 for winding up printed web paper WP in a roll form.

The paper feeder 1 holds the web paper WP in the roll form to be rotatable about a horizontal axis, and unwinds the web paper WP to feed it to the inkjet printing apparatus 3. The takeup roller 5 winds up the web paper WP sent from the inkjet printing apparatus 3 about a horizontal axis. Regarding the side from which the web paper WP is fed as upstream and the side to which the web paper WP is discharged as downstream, the paper feeder 1 is disposed upstream of the inkjet printing apparatus 3 while the takeup roller 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the takeup roller 5 along a plurality of transport rollers 9. A drive roller 11 is disposed between the most downstream transport roller 9 and the takeup roller 5. This drive roller 11 feeds the web paper WP advancing on the transport rollers 9 toward the takeup roller 5.

Between the drive roller 7 and drive roller 11, the inkjet printing apparatus 3 has a printing unit 13, a drying unit 15, and an inspecting unit 17 arranged in the stated order from upstream to downstream. The drying unit 15 dries portions printed by the printing unit 13. The inspecting unit 17 inspects the printed portions for any stains or omissions.

The printing unit 13 has inkjet heads 19 for discharging ink droplets. Generally, a plurality of printing units 13 are arranged along the transport direction of the web paper WP. For example, four printing units 13 are provided separately for black (K), cyan (C), magenta (M), and yellow (Y). However, in order to facilitate understanding of the invention, the following description will be made on an assumption that only one printing unit 13 is provided. The printing unit 13 has a plurality of inkjet heads 19 arranged also in a horizontal direction perpendicular to the transport direction of the web paper WP. The printing unit 13 has enough inkjet heads 19 to perform printing without moving over a printing area in the width direction of the web paper WP. That is, the inkjet printing apparatus 3 in this embodiment performs printing on the web paper WP being fed thereto, with the inkjet heads 19 not moving for primary scanning, but remaining stationary, in the horizontal direction perpendicular to the transport direction of the web paper WP.

The above printing unit 13 will now be described with reference to FIGS. 2 and 3.

The printing unit 13 in this embodiment has 22 inkjet heads 19, and an inkjet head holder 21 holding these inkjet heads 19 all together. The 22 inkjet heads 19 are held by the inkjet head holder 21 as arranged in four rows of five or six each in the width direction of the web paper WP perpendicular to the transport direction thereof. All the inkjet heads 19 penetrate the bottom of the inkjet head holder 21 for discharging ink from the lower surface of the inkjet head holder 21 toward the web paper WP. The number of inkjet heads 19 held by the inkjet head holder 21 is not limited to 22 as in this embodiment.

The inkjet head holder 21 has linear guides 23 arranged in a substantially vertical posture at right and left ends thereof. The inkjet head holder 21 is supported to be vertically movable as guided by the pair of linear guides 23. A pair of right and left ball screws 25 are arranged in a substantially vertical posture at the right and left ends of the inkjet head holder 21. The inkjet head holder 21 is in mesh with the ball screws 25 through nuts not shown. The ball screws 25 are driven to rotate about vertical axes by a pair of motors 27 arranged in upper positions at the right and left ends of the inkjet head holder 21. Therefore, with operation of the pair of motors 27, the inkjet head holder 21 moves up and down. In the following description, the above motors 27 will be called the left motor 27L or the right motor 27R when specifying one of the right and left motors 27.

The inkjet head holder 21 is vertically movable between a "cap position" shown in solid lines in FIG. 3, a "wiper position" shown in dotted lines in FIG. 3, and a "printing position" shown in two-dot chain lines in FIG. 3. In the wiper position, wipers 28 lying leftward in FIGS. 2 and 3 move horizontally along the inkjet heads 19 to wipe off foreign matters adhering to discharge planes of the inkjet heads 19.

The printing unit 13 has 22 caps 29 arranged to correspond to the 22 inkjet heads 19. These caps 29 close ink discharge portions of the respective inkjet heads 19 to the ambient. Each cap 29 prevents drying and contamination of the ink discharge portion of the corresponding inkjet head 19. The caps 29 are held by a cap holder 31.

The cap holder 31, in a state of holding the plurality of caps 29, is movable between the "cap position" under the inkjet head holder 21 as shown in FIG. 3, and a "withdrawn position" at the back of the inkjet head holder 21. The withdrawn position is not shown in the drawings.

The inkjet head holder 21, by operation of the pair of motors 27, is movable also to an "origin position" slightly above the cap position noted above. The origin position is detectable by an origin sensor 32 which is disposed in an upper position. The origin sensor 32 is omitted from FIG. 2, but is shown in FIG. 3 only. The origin position serves as a reference position to which the inkjet head holder 21 is once raised after torsion occurs thereto, as described in detail hereinafter.

Figure 4:
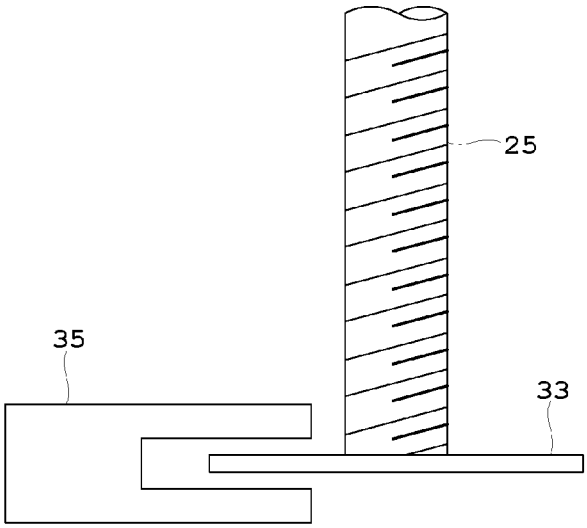
FIG. 4 is a view showing a distal end of a ball screw.
Figure 5:
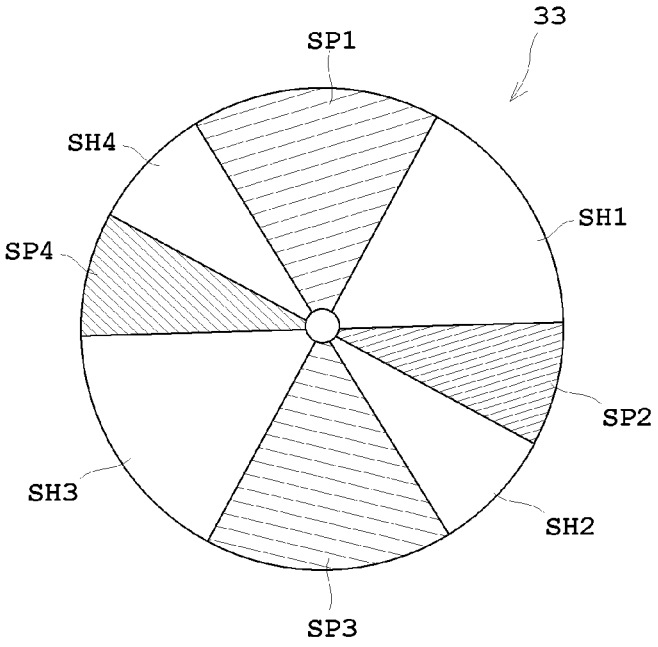
FIG. 5 is a view showing a slit disk.

Reference is now made to FIGS. 4 and 5. FIG. 4 is a view showing a distal end of a ball screw. FIG. 5 is a view showing a slit disk.

Each of the ball screws 25 has a slit disk 33 attached to a lower end thereof. The mounting position of the slit disk 33 is not limited to the lower end of each ball screw 25, as long as rotation of the ball screw 25 can be detected. Therefore, the slit disk 33 may be attached to a position near the motor 27 of each ball screw 25.

The slit disk 33 has at least two types of slits formed therein. In this example, the disk 33 has, formed therein, a slit SP1 in the shape of a sector with a central angle of 60°, a slit SH1 in the shape of a sector with a central angle of 60°, a slit SP2 in the shape of a sector with a central angle of 30°, a slit SH2 in the shape of a sector with a central angle of 30°, a slit SP3 in the shape of a sector with a central angle of 60°, a slit SH3 in the shape of a sector with a central angle of 60°, a slit SP4 in the shape of a sector with a central angle of 30°, and a slit SH4 in the shape of a sector with a central angle of 30°. Here, the slits (hatched slits) affixed with reference sign S"P" are, for example, portions which do not let light through. The slits (slits without hatching) affixed with reference sign S"H" are, for example, portions which let light through. The above construction of the slits is only an example. The disk 33 will serve the purpose as long as at least two types of slits are formed therein.

A slit sensor 35 is disposed laterally of each slit disk 33. The slit sensor 35 detects each of the slits SP1-SP4 and SH1-SH4 formed in the slit disk 33, and outputs a signal. Supposing, for example, that the slit sensor 35 is a transmission type sensor, and the type which detects self-emitted light and outputs ON (the signal level being HIGH), the slit sensor 35 will outputs ON when detecting the slits SH1-SH4, and outputs OFF when detecting the slits SP1-SP4. In the following description, the pair of slit sensors 35 will be referred to as the left-side slit sensor 35L and right-side slit sensor 35R as necessary. Each slit sensor 35 may be the reflection type instead of the transmission type. Each slit sensor 35 is not limited to the optical, noncontact type, but may be a contact type sensor.

The above slit sensors 35 correspond to the "detecting device" in this invention.

Figure 6:
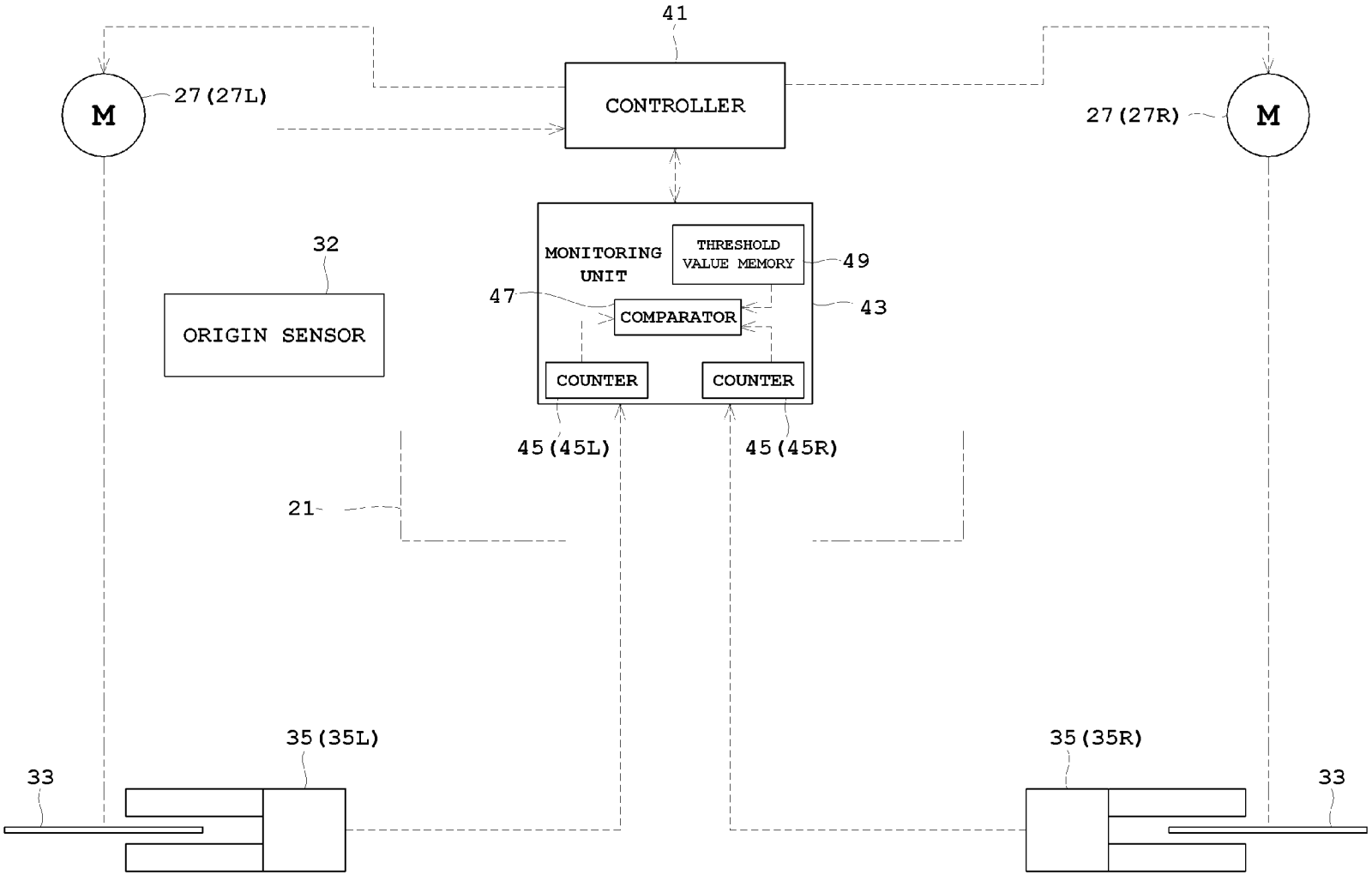
FIG. 6 is a block diagram showing a control system.

Next, reference is made to FIG. 6. FIG. 6 is a block diagram showing a control system.

A controller 41 which corresponds to the "control device" in this invention is formed of a CPU, memory, and so on. The controller 41 controls the pair of motors 27 to rotate the pair of ball screws 25, thereby to raise and lower the inkjet head holder 21 with the inkjet heads 19. The controller 41 receives an output signal of the origin sensor 32, and detects the inkjet head holder 21 having moved to the origin position. The controller 41 controls the pair of motors 27 based on monitoring signals received from a monitoring unit 43 which corresponds to the "monitoring device" in this invention.

The monitoring unit 43 receives output signals from the pair of slit sensors 35, checks whether the pair of motors 27 are operating synchronously and monitors that the directions of rotation of the motors 27 are in agreement. Further, the monitoring unit 43 outputs monitor signals corresponding to results of the monitoring to the controller 41.

The monitoring unit 43 includes a pair of built-in counters 45, and a comparator 47 for comparing count values of the counters 45. The pair of counters 45 consist of a left-side counter 45L and a right-side counter 45R. The comparator 47 reads a predetermined threshold value from a threshold value memory 49 having threshold values stored beforehand, compares the threshold value read and a difference between the count values of the counters 45, and outputs a monitoring signal corresponding to the result to the controller 41. Upon receipt of a reset signal from the controller 41, the monitoring unit 43 resets the count values of the pair of counters 45. The monitoring unit 43 monitors signal widths of the pair of slit sensors 35, and checks whether the directions of rotation of the motors 27 are in agreement.

Figure 7:
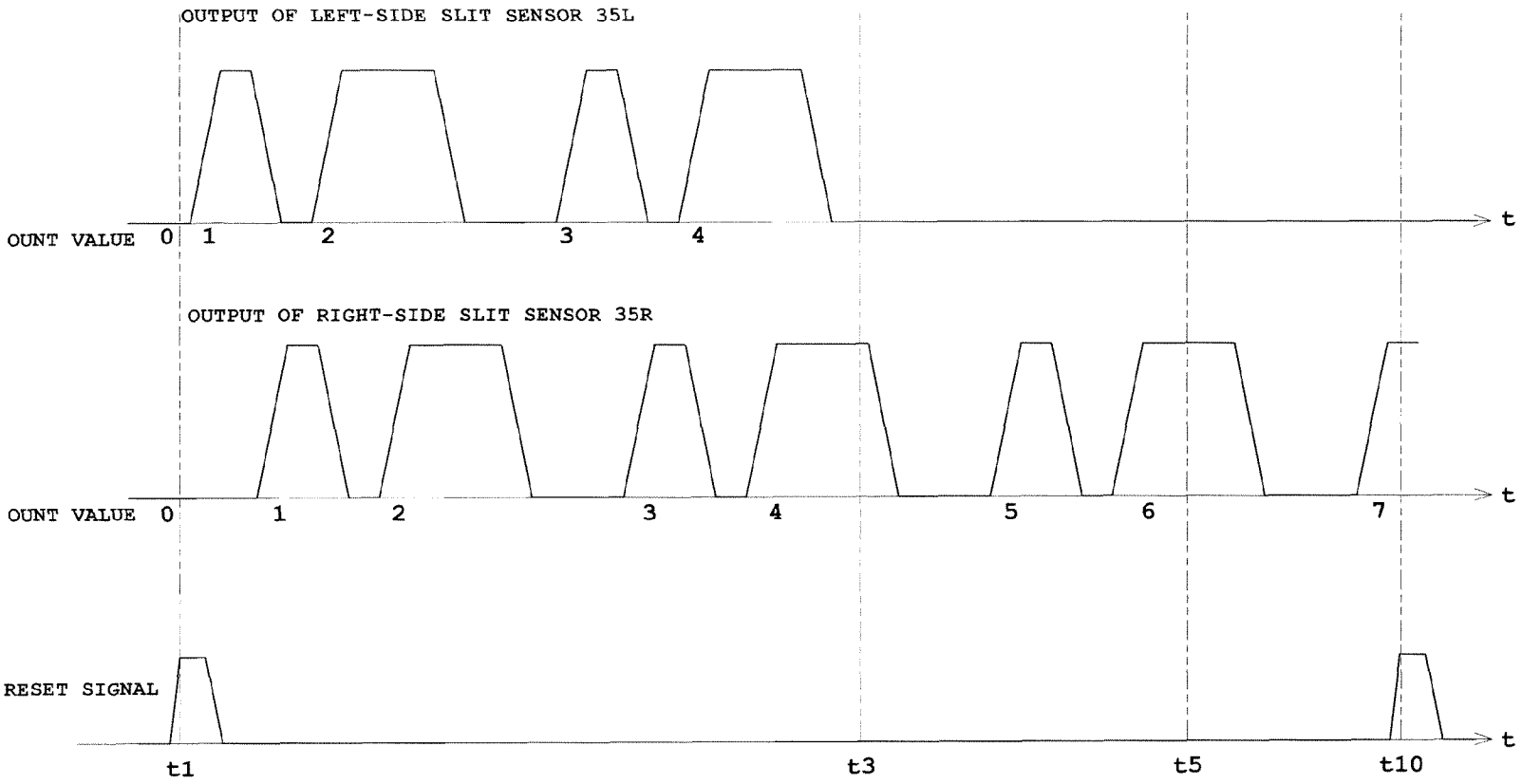
FIG. 7 is a time chart showing an example of detection signals of slit sensors.

Reference is now made to FIG. 7. FIG. 7 is a time chart showing an example of detection signals of the slit sensors.

Assume that the monitoring unit 43 receives the reset signal from the controller 41 at time t1. Then, the monitoring unit 43 resets count values of the pair of counters 45 to start counting from 0. When the controller 41 rotates the pair of motors 27 in the same direction at the same speed, the count values are usually incremented while maintaining a constant difference. Assuming that, in FIG. 7, the left-side slit sensor 35L detects the slits successively in the order of slits SH2, SP2, SH1, SP1 and so on, then the left-side counter 45L counts from 0 to 1, 2, 3 . . . . Assuming that the right-side slit sensor 35R similarly detects the slits successively in the order of slits SH2, SP2, SH1, SP1 and so on, then the right-side counter 45R counts from 0 to 1, 2, 3 . . . . However, since there is a shift in rotation angle between the two slit disks 33, which is due, for example, to an angular shift occurring when the slit disks 33 are attached, a "shift" will occur to the timing of counting. After receipt of the reset signal, with the comparator 47 continually comparing a difference between the count values, the monitoring unit 43 monitors and checks whether the difference has reached or exceeded the threshold value read from the threshold value memory 49.

When, for example, the left-side motor 27L stops at time t3 in FIG. 7, the count value of the left-side slit sensor 35 is stopping at "4" at time t5. Then, at time t5, the count value of the right-side slit sensor 35 is "6". If the threshold value is "2" at this time, the monitoring unit 43 reports occurrence of an abnormality to the controller 41 at time t5.

The monitoring unit 43 monitors signal widths in the outputs of the pair of slit sensors 35, and based on an order of appearance of small and large signal widths, determines a direction of rotation of each motor 27. When the order is reversed, the monitoring unit 43 reports occurrence of an abnormality to the controller 41.

The threshold value memory 49 has a first threshold value X and a second threshold value X+α stored beforehand therein. As described in detail hereinafter, in time of vertical movement in a normal monitoring state, the monitoring unit 43 causes the comparator 47 to use the first threshold value X for comparison. In time of return to the origin position upon occurrence of an abnormality, the monitoring unit 43 causes the comparator 47 to use the second threshold value X+α for comparison. The second threshold value X+α is a value larger by a than the first threshold value X. This is because, when a vertical movement is made following occurrence of an abnormality, use of the first threshold value X for the normal monitoring state will cause an inconvenience of a determination being made immediately that an abnormality has occurred. By using the two types of threshold values separately, it is possible to monitor appropriately also in time of return to the origin following occurrence of an abnormality.

Figure 8:
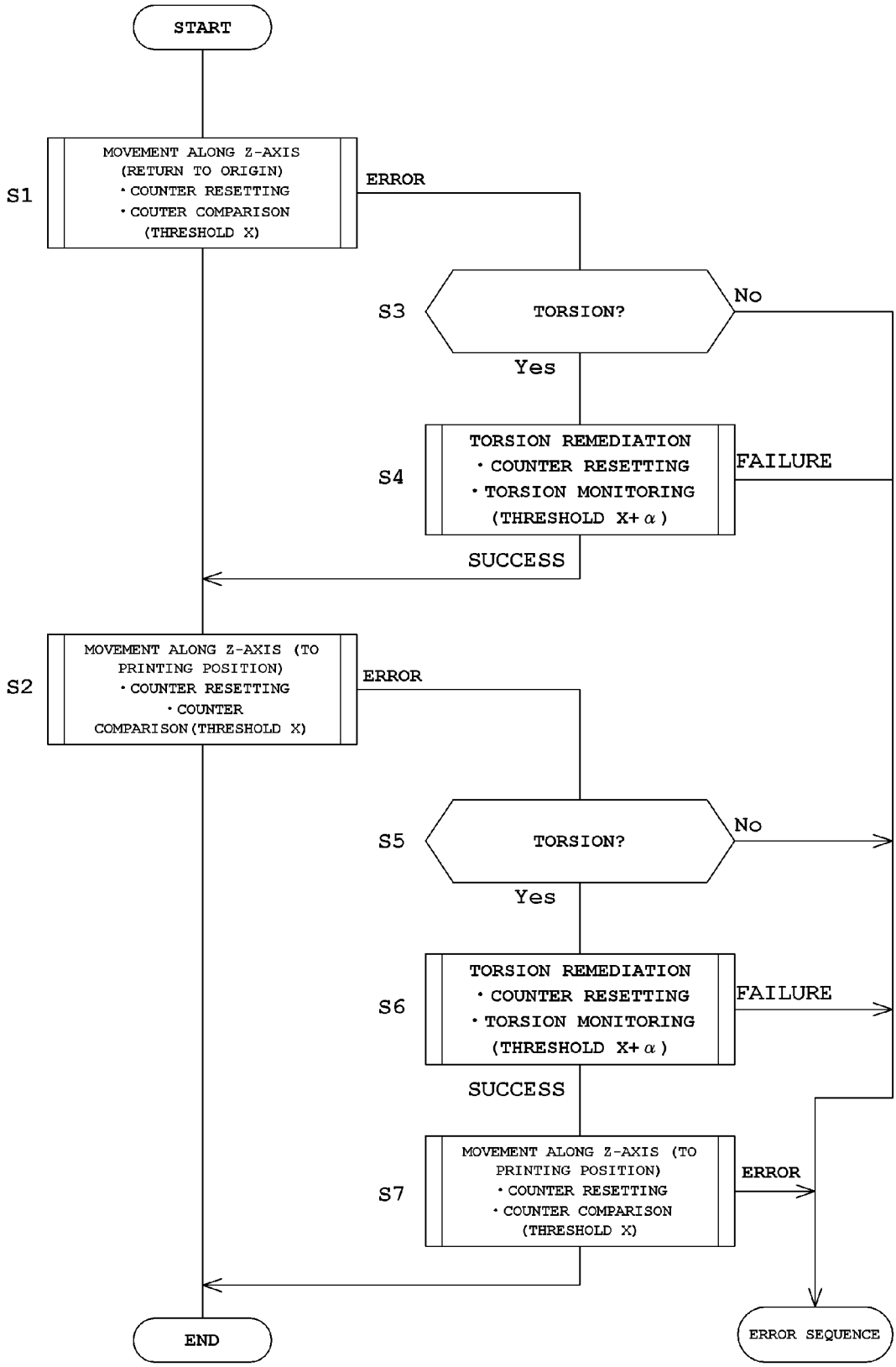
FIG. 8 is a flow chart of operation.
Figure 9:
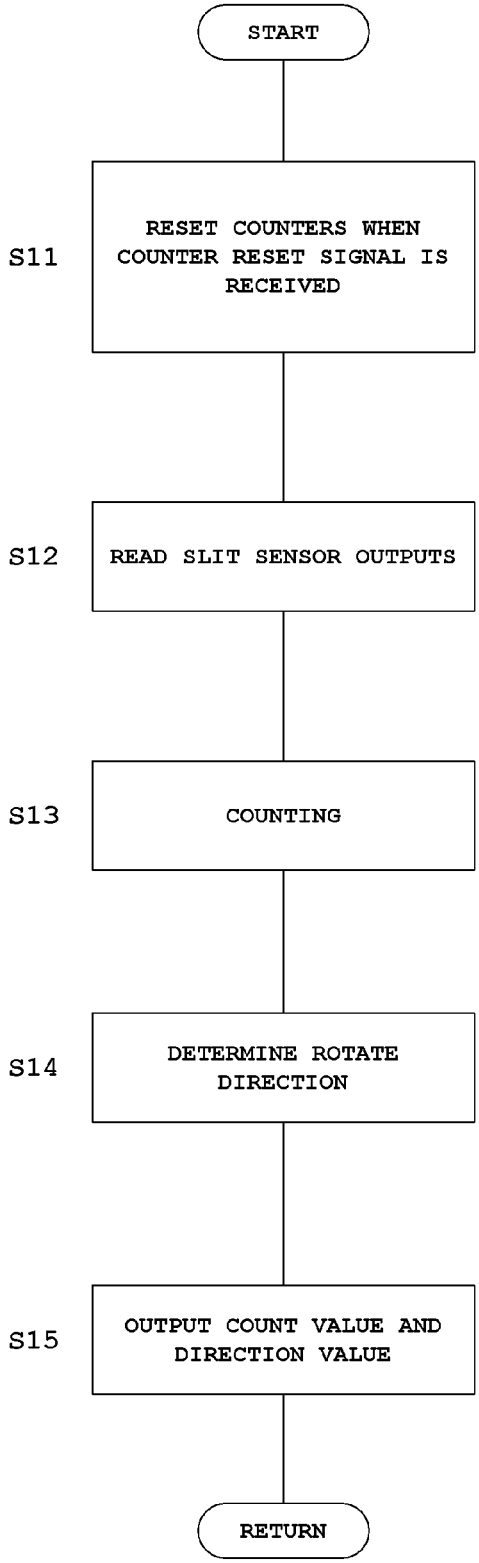
FIG. 9 is a flow chart of torsion monitoring.

Next, operation of the printing unit 13 of the above inkjet printing system will be described with reference to FIGS. 8 and 9. FIG. 8 is a flow chart of operation, and FIG. 9 is a flow chart of torsion monitoring.

The following description will take for example operations for returning the inkjet head holder 21 to the origin position, and lowering the inkjet head holder 21 from the "origin position" to the "printing position".

Step S1

The controller 41 operates the pair of motors 27 to move the inkjet head holder 21 along Z-axis. The Z-axis represents an upward direction in FIG. 3, and the inkjet head holder 21 is raised until the origin sensor 32 starts operation. At this time, no abnormality has occurred, and thus the first threshold value X is used. In this case, the monitoring in FIG. 9 is carried out.

Step S2

When the above step S1 indicates no abnormality, the controller 41 operates the pair of motors 27 to lower the inkjet heads 21 to the printing position. At this time also, the monitoring in FIG. 9 is carried out.

Reference is now made to FIG. 9.

Step S11

The monitoring unit 43 resets the pair of counters 45.

Step S12

The monitoring unit 43 reads the outputs of the pair of slit sensors 35.

Step S13

The monitoring unit 43 causes the pair of counters 45 to count the signals of the slit sensors 35.

Step S14

The monitoring unit 43 determines a direction of rotation based on the signal widths of the slit sensors 35. At this time, for example, sign "+" is used for forward rotation, and sign "−" for reverse rotation.

Step S15

The monitoring unit 43 outputs current count values of the pair of counters 45 and a direction of rotation currently determined. The monitoring unit 43 causes the comparator 47 to compare the first threshold value X and a difference between the count values. When the difference reaches or exceeds the first threshold value X, the monitoring unit 43 outputs an error signal to the controller 41. The monitoring unit 43 outputs the error signal to the controller 41 similarly when it is determined that the direction of rotation has reversed. Although description is omitted, the error signal is outputted to the controller 41 similarly upon occurrence of an error other than torsion. An error other than torsion is, for example, the case of the origin sensor 32 not turning on even upon lapse of a predetermined time after start of movement to the origin position.

Reference is now made back to FIG. 8.

Step S3

The controller 41, having received the error signal from the monitoring unit 43, branches the process based on the difference between the count values, the direction of rotation determined by the monitoring unit 43 and other signals. When, for example, torsion has occurred to the inkjet head holder 21, that is when the difference has reached or exceeded the first threshold value X or the directions of rotation of the pair of motors 27 have been reversed to each other, the process moves to step S4. In the case of other errors, the process moves to an error sequence. This error sequence, for example, stops the pair of motors 27, and displays a message such as "An unrecoverable abnormality has happened. Report to the Service Center!!"

Step S4

When a "torsion" has occurred to the inkjet head holder 21, a torsion remediation process is carried out.

Specifically, the controller 41 causes the monitoring unit 43 to reset the pair of counters 45. Further, the controller 41 instructs the monitoring unit 43 to carry out comparison with the second threshold value X+α. While the torsion monitoring is carried out with the second threshold value X+α set, the controller 41 operates the pair of motors 27 to move the inkjet head holder 21 to the origin position. When the inkjet head holder 21 has attained the origin position, the result is a "success" and the process moves to step S2. On the other hand, when torsion has occurred again to the inkjet head holder 21 during the movement to the origin position, the result is a "failure" and the operation moves to the error sequence.

Description will be made hereinafter on an assumption that the movement to the origin position has been a "success".

Step S2

The controller 41 operates the pair of motors 27 to lower the inkjet head holder 21 from the origin position to the printing position. At this time, the first threshold value X is set, and the monitoring in FIG. 9 is performed as described above. Assume that an error occurs at this time.

Step S5

When an error signal is outputted from the monitoring unit 43 to the controller 41, the controller 41 branches the process based on the difference between the count values and the direction of rotation determined by the monitoring unit 43, and other signals. When, for example, torsion has occurred to the inkjet head holder 21, the process moves to step S6. In the case of other errors, the process moves to the error sequence.

Assume here that a "torsion" has occurred.

Step S6

When torsion has occurred to the inkjet head holder 21, the torsion remediation process is performed by returning the inkjet head holder 21 to the origin position. At this time, the monitoring unit 43 carries out monitoring with the second threshold value X+α. When the torsion remediation is a "failure", the process moves to the error sequence. On the other hand, when the torsion remediation is a "success", the process moves to step S7.

Step S7

The controller 41 operates the pair of motors 27 to lower the inkjet head holder 21 to the printing position. At this time, the first threshold value X is set, and the monitoring in FIG. 9 is performed. When the movement to the printing position is completed as a result, the process is ended to give way to a printing process. On the other hand, when an error occurs, the pair of motors 27 are stopped, and the process moves to the error sequence.

Thus, in the apparatus in this embodiment, the controller 41, when an error occurs during movement of the inkjet head holder 21, makes at least one retry (steps S4 and S6) aiming at torsion remediation. This can inhibit the frequency of performing the error sequence, and can improve the operating rate of the apparatus.

In the apparatus in this embodiment, as described above, when the controller 41 operates the two motors 27 to move the inkjet head holder 21 vertically, the monitoring unit 43 monitors the signals of the respective slit sensors 35. Based on the signals of the respective slit sensors 35, the monitoring unit 43 monitors synchronous rotations of the two motors 27, and corresponding directions of rotation of the two motors 27. An abnormality occurring to these indicates that torsion has occurred to the inkjet head holder 21. This allows a measure to be taken such as stopping rotation of each motor 27. As a result, damage to the inkjet head holder 21 can be prevented.

When an abnormality is determined to have occurred, the controller 41 stops each motor 27, and operates each motor 27 to move the inkjet head holder 21 to the origin position. This may eliminate the abnormality occurring to the vertical movement of the inkjet head holder 21. Then, the inkjet head holder 21 can be moved vertically again. As a result, the frequency of stopping the apparatus for maintenance can be inhibited to improve the operating rate of the apparatus.

When the inkjet head holder 21 is moved to the origin position after an abnormality has occurred as in step S4 or S6, the torsion of the inkjet head holder 21 could worsen to cause damage during the movement. However, such an inconvenience can be prevented by the monitoring unit 43 carrying out monitoring also at the time of movement.

This invention is not limited to the foregoing embodiment, but may be modified as follows:

(1) In the foregoing embodiment, the inkjet head holder 21 is moved vertically by the two motors 27. However, this invention is not limited to the two motors 27, but is applicable also where, for example, three or more motors 27 are provided. In this case, occurrence of torsion may be checked by comparing differences between the count values of two motors 27 in all combinations (three ways) and the threshold values.

(2) In the foregoing embodiment, the inkjet head holder 21 is returned to the origin position when an abnormality has occurred. However, instead of the return to the origin position, the movement to the printing position may be continued only by setting the threshold value to the second threshold value $X+\alpha$. And the process may move to the error sequence as soon as the second threshold value $X+\alpha$ is reached or exceeded. The inkjet head holder 21 may be stopped instead of being returned to the original position.

This can eliminate the time required for the return to the original position.

(3) In the foregoing embodiment, the slit disks 33 have sector-shaped slits. This invention is not limited to such slits. It is possible to employ, for example, linear slits having different lengths in the direction of rotation.

(4) In the foregoing embodiment, the inkjet head holder 21 is moved by the pair of ball screws 25. However, this invention is not limited to this construction. For example, the ball screws 25 may be replaced with racks and pinions, chains or belts.

(5) The foregoing embodiment has been described taking for example the inkjet printing apparatus which performs printing on the web paper WP. This invention is applicable also to an inkjet printing apparatus for printing on cut-sheet paper.

(6) The foregoing embodiment has been described taking for example what is called one-pass apparatus. This invention is not limited to the one-pass apparatus, but is applicable to any inkjet printing apparatus with a mechanism for vertically moving the inkjet head holder 21.

This invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for printing images on printing paper by discharging ink while moving inkjet heads and the printing paper relative to each other, comprising:

an inkjet head holder for holding the inkjet heads to be movable by at least two shafts extending vertically;

a control device for operating at least two motors respectively coupled to the at least two shafts to move the inkjet head holder vertically along the at least two shafts at least between a printing position, a standby position of the inkjet head holder, and an origin position above the standby position;

a detecting device for detecting slits formed in at least two different sizes in each of slit disks rotatable by the at least two motors, and outputting detection signals concerning synchronous rotations of the at least two motors and directions of rotation of the at least two motors; and a monitoring device for monitoring, during a vertical movement of the inkjet head holder caused by the control device, synchronous rotations of the at least two motors by monitoring the signals outputted from the detecting device and counting the slits of the slit disks, and corresponding directions of rotation of the at least two motors by monitoring orders in which the slits of the slit disks appear, the monitoring device having at least two counters respectively for storing counts of the slits of the slit disks provided for the at least two motors, respectively, and a comparator for comparing a difference between the counts of the at least two counters and one of a first threshold value for a time of normal vertical movement and a second threshold value for a time of return to the origin position after occurrence of an abnormality, wherein the control device causes the comparator of the monitoring device to compare the difference between the counts of the at least two counters and the first threshold value at the time of normal vertical movement, and when the monitoring device has detected occurrence of an abnormality, the control device:

raises the inkjet head holder to the origin position while causing the comparator to compare the difference between the counts of the at least two counters and the second threshold value, and only when the inkjet head holder has been able to reach the origin position, lowers the inkjet head holder from the origin position to the printing position.

2. The inkjet printing apparatus according to claim 1, the slit disks are attached to a plurality of ball screws extending in a direction of vertical movement of the inkjet head holder and rotatable by the plurality of motors for vertically moving the inkjet head holder.

3. The inkjet printing apparatus according to claim 1, wherein the origin position has an origin sensor, and based on the origin sensor detecting the inkjet head holder, the control device recognizes that the inkjet head holder has reached the origin position.

4. The inkjet printing apparatus according to claim 1, wherein the first threshold value and the second threshold value provided for the comparator are in a relationship of the first threshold value<the second threshold value.

5. The inkjet printing apparatus according to claim 1, wherein only when the inkjet head holder has been able to reach the origin position, it is done only once that the control device lowers the inkjet head holder from the origin position to the printing position.

* * * * *